US007387543B1

(12) United States Patent
Wu et al.

(10) Patent No.: US 7,387,543 B1
(45) Date of Patent: Jun. 17, 2008

(54) AUDIO JACK CONNECTOR

(75) Inventors: Yin-Lung Wu, Taipei Hsien (TW); Ming-Chiang Chen, Taipei Hsien (TW); Min Song, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/751,993

(22) Filed: May 22, 2007

(51) Int. Cl.
*H01R 24/04* (2006.01)

(52) U.S. Cl. ..... 439/668

(58) Field of Classification Search ..... 439/668, 439/669

See application file for complete search history.

(56) References Cited

U.S. PATENT DOCUMENTS 6,368,156 B1 * 4/2002 Lin ..... 439/668
6,478,629 B1 * 11/2002 Li et al. ..... 439/668
7,033,226 B1 * 4/2006 Chien et al. ..... 439/668
7,238,059 B1 * 7/2007 Wu ..... 439/668
D555,098 S * 11/2007 Wu et al. ..... D13/133
2007/0249235 A1 * 10/2007 Wu ..... 439/668

* cited by examiner

*Primary Examiner*—James Harvey
(74) *Attorney, Agent, or Firm*—WPAT, P.C.; Anthony King

(57) ABSTRACT

An audio jack connector includes an insulative housing and a terminal group received in the insulative housing. The housing has a body, a mating portion extending from one end of the body along an axis direction of the body and an insertion hole defined in the mating portion and passing through the body and mating portion along the axis direction of the body. At least slots connected to the insertion hole are defined in the body. The terminal group includes a first set of terminals with simple supported beam structure and a second set of terminals with cantilever beam structure. The first set of terminals with simple supported beam structure have an U-shaped fixed portion with two side arms defined at the opposite sides of the fixed portion. A resilient arm connects the side arms together. The resilient arm has a contact portion at the middle, the contact portion projects inward into the insertion hole, so the outer surface of the first resilient arm is formed as a concave.

4 Claims, 4 Drawing Sheets

AUDIO JACK CONNECTOR

BACKGROUND OF THE INVENTION

1. Field of the Invention

The present invention relates to an audio jack connector, and more particularly to an audio jack connector which increases the interference action between a plug and terminals.

2. The Related Art

Video and music equipments develop quickly in recent years. The stability for an audio jack connector matching with a plug is required. A conventional audio jack connector includes an insulative housing and a plurality of terminals received therein. The terminal is bent to form a cantilever beam shape by a conductive material. When one end of the terminal presses against a plug, the other end of the terminal is received in the insulative housing. During the process of inserting, the deformation of the terminal oversteps the bounds of the terminals easily, and then the terminal can't provide enough elastic force to press against the plug and enough friction to keep the plug hold firmly in the audio jack connector to transmit signal stably.

Thus, it would be desirable to provide an audio jack connector which overcomes the problems encountered with previous art.

SUMMARY OF THE INVENTION

An object of the present invention is to provide an audio jack connector including an insulative housing and a terminal group received in the insulative housing. The housing has a body, a mating portion extending from one end of the body along an axis direction of the body and an insertion hole defined in the mating portion and passing through the body and mating portion along the axis direction of the body. At least two slots connected to the insertion hole are defined in the body. Said terminal group is configured to the slots. The terminal group includes a first set of terminals with simple supported beam structure and a second set of terminals with cantilever beam structure. The first set of terminals with simple supported beam structure have an U-shaped fixed portion with two side arms defined at opposite sides of the fixed portion. A resilient arm connects the side arms together. The resilient arm has a contact portion at the middle, the contact portion projects inward into the insertion hole, so the outer surface of the first resilient arm is formed as a concave.

When the audio jack connector mates with the plug, the first set of terminals with simple supported beam structure of the audio jack connector abut against the plug for transmitting signal. The resilient arm between the side arms of the fixed portion can provide even more elastic force and friction between the plug and the first set of terminals.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
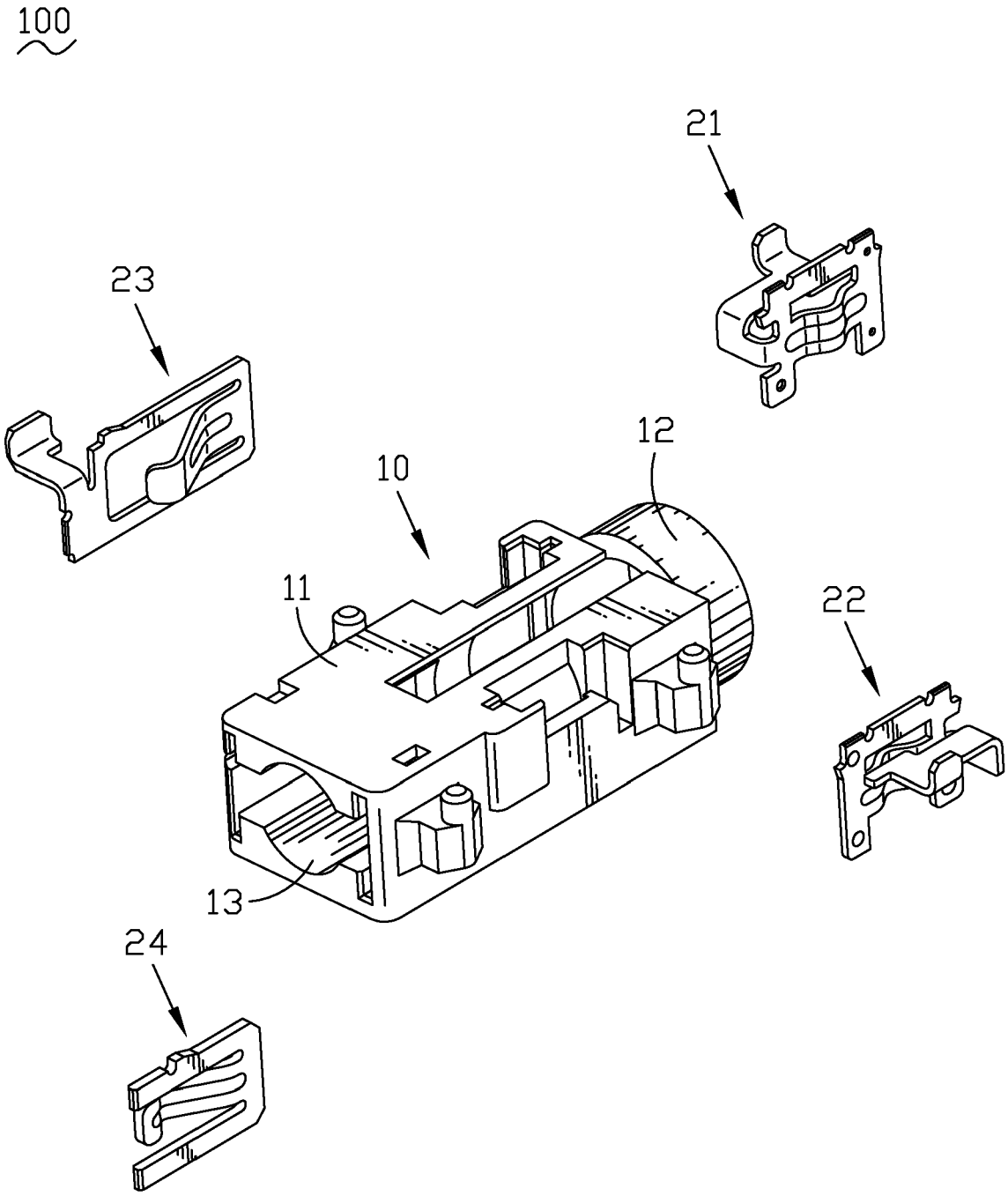
FIG. 1 is an exploded view of an audio jack connector in accordance with the present invention.

With reference to FIG. 1, an audio jack connector 100 includes an insulative housing 10 and a terminal group received in the insulative housing 10. The housing 10 has an oblong body 11, a mating portion 12 extending from one end of the body 11 along an axis direction of the body 11, and an insertion hole 13 defined in the mating portion 12 and passing through the body 11 and mating portion 12 along the axis direction of the body 11.

Figure 2:
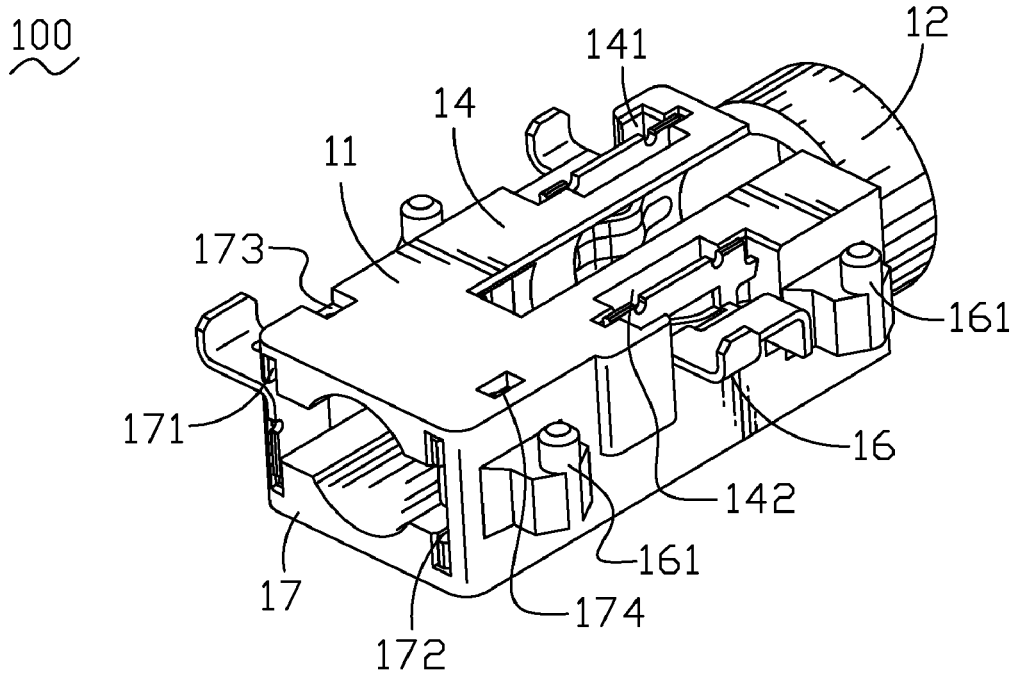
FIG. 2 is a perspective view of the audio jack connector of FIG. 1.
Figure 3:
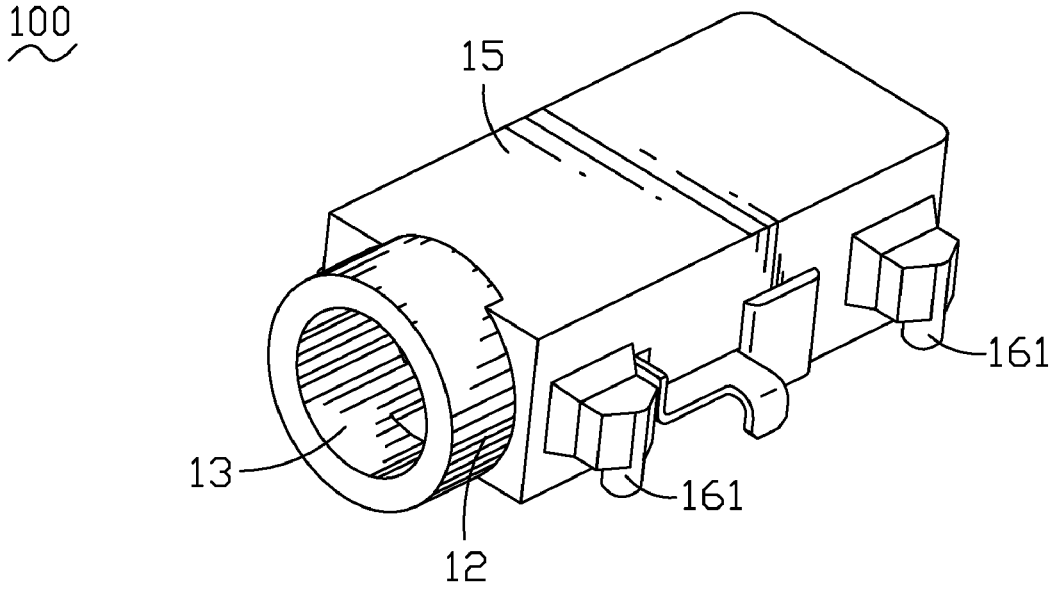
FIG. 3 is another angle perspective view of the audio jack connector shown in FIG. 2.

Referring to FIG. 2 and FIG. 3, the body 11 has a top wall 14, a bottom wall 15, two sidewalls 16 and a back wall 17. The top wall 14 defines a first slot 141 and a second slot 142 at the opposite sides of the front and is connected with the insertion hole 13. The sidewalls 16 have a plurality of location pegs 161 which can be inserted into proper locations of a Printed Circuit Board (not shown). The back wall 17 defines a third slot 171 and a fourth slot 172 at two opposite sides of the rear and is connected with the insertion hole 13. A first opening 173 defined at the front of the third slot 171 passes through the top wall 14. A second opening 174 defined at the front of the fourth slot 172 passes through the top wall 14.

Figure 4:
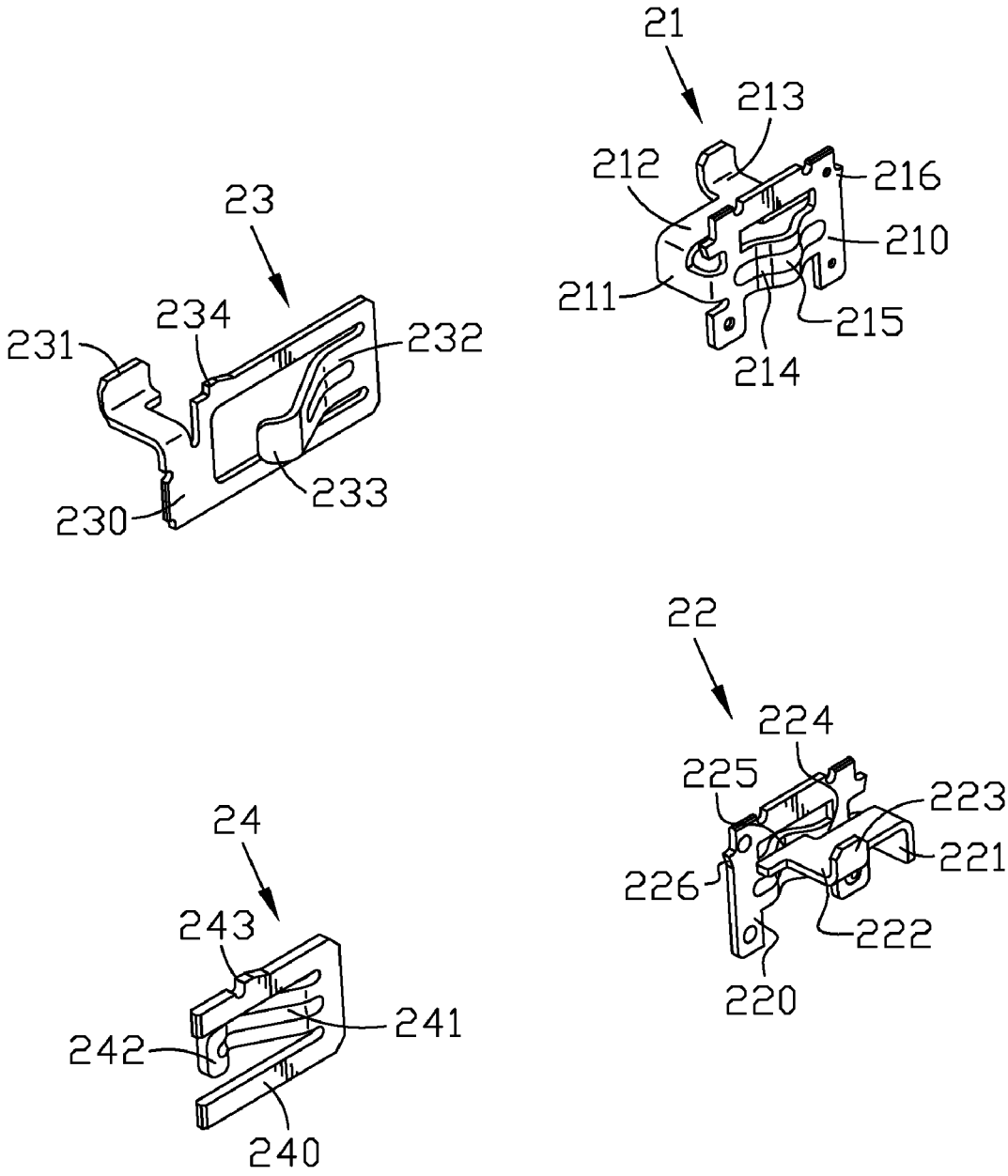
FIG. 4 is a perspective view of a terminal group of the audio jack connector.

Please referring to FIG. 4, the terminal group includes a first set of terminals with simple supported beam structure and a second set of terminals with cantilever beam structure. The first set of terminals with simple supported beam structure have a first terminal 21 and a second terminal 22. The second set of terminals with cantilever beam structure have a third terminal 23 and a fourth terminal 24. The first terminal 21, the second terminal 22 and the third terminal 23 are signal terminals, and the fourth terminal 24 is a fixed terminal.

The first terminal 21 has an U-shaped first fixed portion 210 with a hatch face in downward direction. The fixed portion 210 has two side arms. A first connecting portion 211 extends outwardly from the middle of the outside of the rear side arm. A second connecting portion 212 extends forward from the top of the outside of the first connecting portion 211. The first connecting portion 211 intersects the second connecting portion 212 at a right angle. A first soldering portion 213 extends outwardly and then bends upwardly from the front end of the outside of the second connecting portion 212. A first resilient arm 214 connects the side arms of the fixed portion 210 together. The first resilient arm 214 has a first contact portion 215 projecting inwardly at the middle, therefore, the outer surface of the first resilient arm 214 is formed as a concave. A first bump 216 is defined on the first fixed portion 210.

The second terminal 22 is similar to the first terminal 21. Correspondingly, the second terminal 22 has a second fixed portion 220, a third connecting portion 221, a fourth connecting portion 222, a second soldering portion 223, a second resilient arm 224, a second contact portion 225 and a second bump 226.

The third terminal 23 has a third fixed portion 230 with an approximate rectangular loop configuration. A third soldering portion 231 extends outwardly and bends upwardly from the rear of the third fixed portion 230. A third resilient arm 232 extends rearward from the front of the third fixed portion 230. A third contact portion 233 projects from the end of the third resilient arm 232. The third fixed portion 230 has a third bump 234 defined at the top.

The fourth terminal 24 has an U-shaped fourth fixed portion 240 with a hatch face at the rear, a fourth resilient arm 241 extending rearward from the front of the fourth fixed portion 240 and a fourth contact portion 242 projecting from the end of the fourth resilient arm 241. The fourth fixed portion 240 has a fourth bump 243 at the bottom thereof.

Please refer to FIG. 2 and FIG. 3. The terminals 21, 22, 23, 24 are respectively configured to the insulative housing 10 with the fixed portions 210, 220, 230, 240 respectively fixed in the first slot 141, the second slot 142, the third slot 171 and the fourth slot 172. Meanwhile, the first bump 216 and the second bump 226 are locked in the interior of the first slot 141 and second slot 142, and the third bump 234 and the fourth bump 243 are locked in the first opening 173 and the second opening 174. The contact portions 215, 225, 233, 242 stretch into the insertion hole 13, and the soldering portions 213, 223, 231 stretch out of the insulative housing 10 for soldering on the Printed Circuit Board. The location pegs 161 are connected to the external article to fix the audio jack connector 100.

Figure 5:
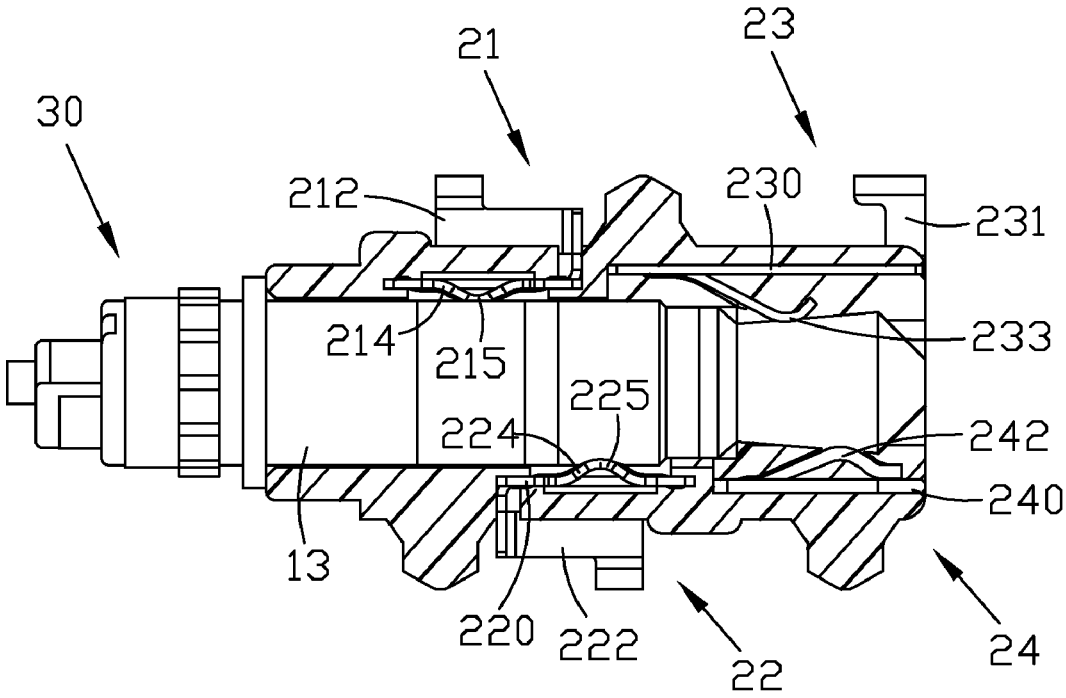
FIG. 5 is a cross-sectional view of the audio jack connector, with a plug inserted into the audio jack connector.

Referring to FIG. 5, when the audio jack connector 100 and a plug 30 mate with each other, the plug 30 inserted into the insertion hole 13 presses against the terminals 21, 22, 23, 24. The contact portions 215, 225, 233 of the terminals 21, 22, 23 abut against a mating terminal of the plug 30, and the fourth contact portion 242 abuts against one side of the plug 30 to balance the force with which the plug 30 provides thereof.

As described above, in the process of inserting thereof, the first set of terminals with simple supported beam structure of the audio jack connector 100 press against the plug 30 to transmit signal. The first set of terminals are deformed gradually by the stress of the plug 30, and the resilient arm of the fixed portion can provide even more elastic force between the plug 30 and the first set of terminals. Meanwhile, the friction between the plug 30 and the first set of terminals is increased for the elastic force which exists between the plug 30 and the first set of terminals. So the plug 30 and the first set of terminals are biased toward each other to keep the first set of terminals pressed firmly against the plug 30.

The foregoing description of the present invention has been presented for purpose of the illustration and description. It is not intended to be exhaustive or to limit the invention to the precise from disclosed, and obviously many modifications and variations are possible in light of the above teaching. The various changes in the size, shape, material, and components as well as in the detail of the illustrated construction may be made without departing from the spirit of the invention.

What is claimed is:

1. An audio jack connector comprising:

an insulative housing having a body, a mating portion extending from one end of the body along an axis direction of the body and an insertion hole defined in the mating portion and passing through the body and mating portion along the axis direction of the body, said body including at least two slots connected to the insertion hole; and a terminal group, received in the slots of the insulative housing, having a first set of terminals with simple supported beam structure and a second set of terminals with cantilever beam structure, said first set of terminals with simple supported beam structure having a fixed portion with two side arms, and a resilient arm connecting the side arms together, the resilient arm further having a contact portion at the middle, the contact portion projecting inward into the insertion hole, the outer surface of the resilient arm being formed as a concave.

2. The audio jack connector as claimed in claim 1, wherein the first set of terminals with simple supported beam structure have a first terminal and a second terminal which are received in the front of the body, the second set of terminals with cantilever beam structure have a third terminal and a fourth terminal which are received in the rear of the body.

3. The audio jack connector as claimed in claim 1, wherein the fixed portions of said first set of terminals with simple supported beam structure have an U-shaped structure.

4. The audio jack connector as claimed in claim 3, wherein one of the side arms extends outwardly at the middle to form a first connecting portion, the first connecting portion extends toward the other side arm at a top of the out side to form a second connecting portion, the second connecting portion extends outwardly and then bends upwardly at the end to form a soldering portion.

* * * * *